United States Patent [19]

Beckberger et al.

[11] 4,272,251

[45] Jun. 9, 1981

[54] PROCESS FOR REMOVING SULFUR FROM COAL

[75] Inventors: LaVern H. Beckberger, Markham; James L. Barbour, Homewood, both of Ill.

[73] Assignee: Atlantic Richfield Company, Philadelphia, Pa.

[21] Appl. No.: 74,033

[22] Filed: Sep. 10, 1979

[51] Int. Cl.[3] ..... C10L 9/00; C10L 9/06

[52] U.S. Cl. ..... 44/1 SR; 209/158

[58] Field of Search ..... 44/1 SR, 51; 201/17; 209/162, 163, 168, 170, 171, 173, 187, 158

[56] References Cited

U.S. PATENT DOCUMENTS

| | | | |
|---|---|---|---|
| 2,859,872 | 11/1958 | Hirt | 209/158 |
| 3,261,559 | 7/1966 | Yavorsky et al. | 209/158 X |
| 3,768,988 | 10/1973 | Meyers | 44/1 SR |
| 3,824,084 | 7/1974 | Dillon | 44/1 SR |
| 4,033,729 | 7/1977 | Capes et al. | 44/1 A |

*Primary Examiner*—Carl F. Dees

*Attorney, Agent, or Firm*—John B. Goodman

[57] ABSTRACT

A process for reducing the sulfur content of coal, by the treatment of coal particles, contained in an aqueous slurry, of floatable coal-oil particles, with an oxygen-containing gas at elevated temperature and pressure, comprising the steps of:

(a) feeding the oxygen-containing gas and the aqueous slurry of floatable coal-oil particles, at process pressure, to a bottom zone of a vertically disposed, elongated reactor vessel;

(b) passing the gas and aqueous slurry in cocurrent flow upwardly through a baffled reaction zone, maintained at reaction temperature and pressure, the baffled reaction zone having a plurality of baffle plates spaced therethrough generally normal to the reactor wall, each baffle plate having a configuration generally conforming to the internal diameter of the reactor vessel and a plurality of apertures disposed about the baffle plate, to provide a total aperture area equal to from about 3% to about 28% of the vessel cross-sectional area as free area;

(c) continuously withdrawing the aqueous slurry and spent gas from a top zone of the reactor vessel; and (d) recovering from the aqueous slurry coal-oil particles wherein the coal particles possess a reduced sulfur content.

35 Claims, 9 Drawing Figures

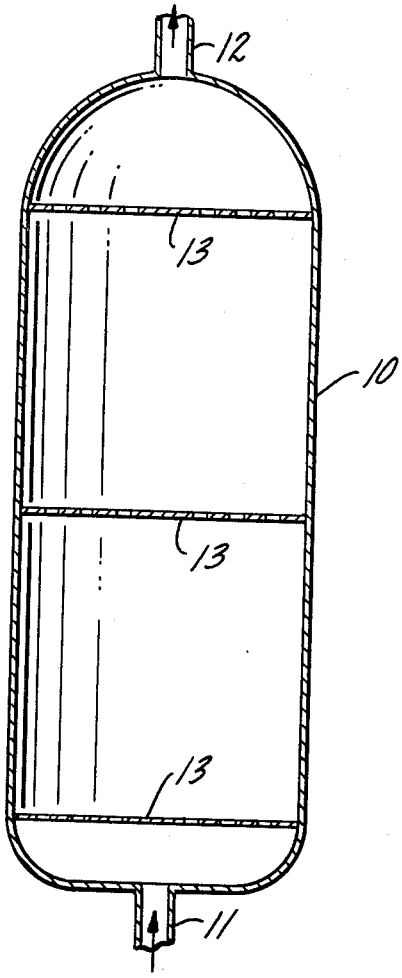
fig.1.
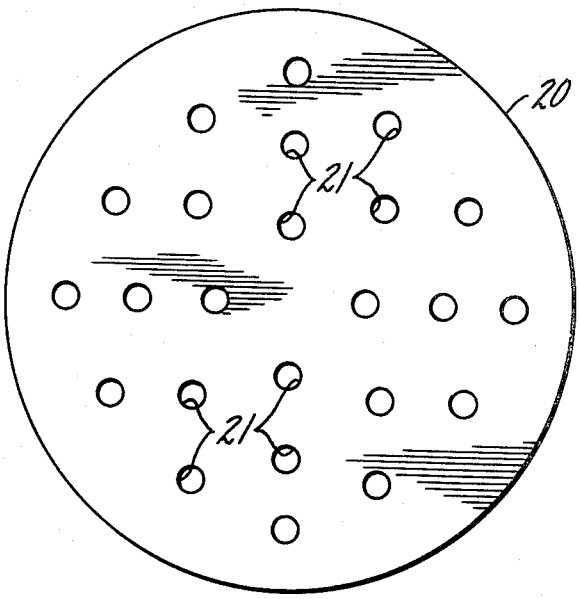
fig.2.
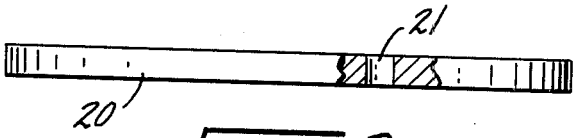
fig.3.
fig.4.
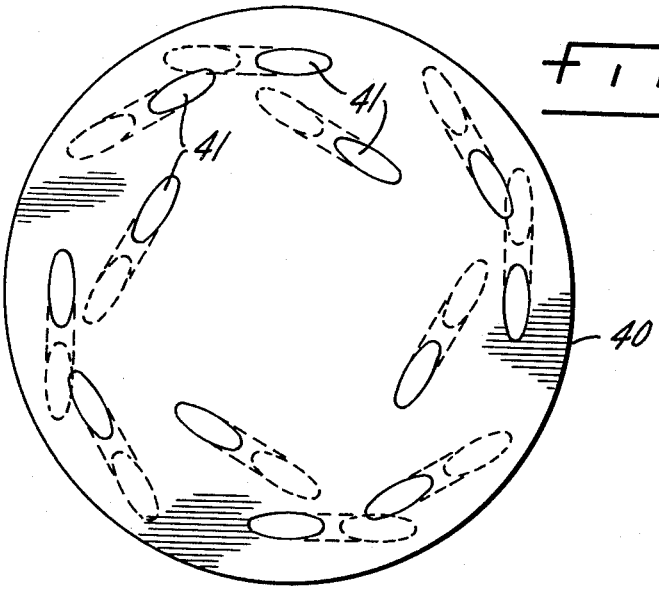
fig.5.
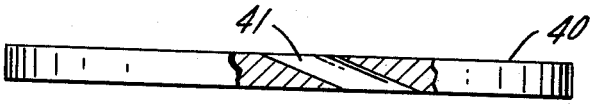

PROCESS FOR REMOVING SULFUR FROM COAL

BACKGROUND OF THE INVENTION

This invention relates to a continuous process for reducing the sulfur content of coal.

It is recognized that an air pollution problem exists whenever sulfur-containing fuels are burned. The resulting sulfur oxides are particularly objectionable pollutants because they can combine with moisture to form corrosive acidic compositions which can be harmful and/or toxic to living organisms in very low concentrations.

Coal is an important fuel and large amounts are burned in thermal generating plants primarily for conversion into electrical energy. Many coals generate significant and unacceptable amounts of sulfur oxides on burning. The extent of the air pollution problem arising therefrom is readily appreciated when it is recognized that coal combustion currently accounts for 60 to 65% of the total sulfur oxides emissions in the United States.

The sulfur content of coal, nearly all of which is emitted as sulfur oxides during combustion, is present in both inorganic and organic forms. The inorganic sulfur compounds are mainly iron pyrites, with lesser amounts of other metal pyrites and metal sulfates. The organic sulfur may be in the form of thiols, disulfides, sulfides and/or thiophenes chemically associated with the coal structure itself. Depending on the particular coal, the sulfur content may be primarily either inorganic or organic. Distribution between the two forms varies widely among various coals. For example, both Appalachian and Eastern interior coals are known to be rich in both pyritic and organic sulfur. Generally, the pyritic sulfur represents from about 25% to 70% of the total sulfur content in these coals.

Heretofore, it has been recognized to be highly desirable to reduce the sulfur content of coal prior to combustion. In this regard, a number of processes have been suggested for physically reducing the inorganic portion of the sulfur in coal. Organic sulfur cannot be physically removed from coal.

As an example, it is known that at least some pyritic sulfur can be physically removed from coal by grinding and subjecting the ground coal to froth flotation or washing processes. These processes are not fully satisfactory because a significant portion of the pyritic sulfur and ash are not removed. Attempts to increase the portion of pyritic sulfur removed have not been successful because these processes are not sufficiently selective. Because the processes are not sufficiently selective, attempts to increase pyrite removal can result in a large portion of coal being discarded along with ash and pyrite.

There have also been suggestions heretofore to remove pyritic sulfur from coal by chemical means. For example, U.S. Pat. No. 3,768,988 discloses a process for reducing the pyritic sulfur content of coal by exposing coal particles to a solution of ferric chloride. The patent suggests that in this process ferric chloride reacts with pyritic sulfur to provide free sulfur according to the following reaction process:

$$2FeCl_3 + FeS_2 \rightarrow 3FeCl_2 + 2S$$

While this process is of interest for removing pyritic sulfur, a disadvantage of the process is that the liberated sulfur solids must then be separated from the coal solids. Processes involving froth flotation, vaporization and solvent extraction are proposed to separate the sulfur solids. All of these proposals, however, inherently introduce a second discrete process step, with its attendant problems and cost, to remove the sulfur from coal. In addition, this process is notably deficient in that it does not remove organic sulfur from coal.

In another approach, U.S. Pat. No. 3,824,084 discloses a process involving grinding coal containing pyritic sulfur in the presence of water to form a slurry, and then heating the slurry under pressure in the presence of oxygen. The patent discloses that under these conditions the pyritic sulfur (for example, $FeS_2$) can react to form ferrous sulfate and sulfuric acid which can further react to form ferric sulfate. The patent discloses that typical reaction equations for the process at the conditions specified are as follows:

$$FeS_2 + H_2O + 7/2\ O_2 \rightarrow FeSO_4 + H_2SO_4$$

$$2FeSO_4 + H_2SO_4 + \tfrac{1}{2}\ O_2 \rightarrow Fe_2(SO_4)_3 + H_2O.$$

These reaction equations indicate that in this particular process the pyritic sulfur content continues to be associated with the iron as sulfate. While it apparently does not always occur, a disadvantage of this is that insoluble material, basic ferric sulfate, can be formed. When this occurs, a discrete separation procedure must be employed to remove this solid material from the coal solids to adequately reduce sulfur content. In addition elemental sulfur can be formed and deposit on the coal. Removing this elemental sulfur presents a problem. Several other factors detract from the desirability of this process. The oxidation of sulfur in the process does not proceed at a rapid rate, thereby limiting output for a given processing capacity. In addition, the above oxidation process is not highly selective in that considerable amounts of coal itself are oxidized. This is undesirable, of course, since the amount and/or heating value of the coal recovered from the process is decreased.

Heretofore, it has been known that coal particles could be agglomerated with hydrocarbon oils. For example, U.S. Pat. Nos. 3,856,668 and 3,665,066 disclose processes for recovering coal fines by agglomerating the fine coal particles with oil. U.S. Pat. Nos. 3,268,071 and 4,033,729 disclose processes involving agglomerating coal particles with oil in order to provide a separation of coal from ash. While these processes can provide some benefication of coal, better removal of ash and iron pyrite mineral matter would be desirable.

The discovery that coal particles, when agglomerated with oil, can be more amenable to sulfur removal in processes wherein the sulfur is oxidized to remove the sulfur from coal was first disclosed in U.S. patent application Ser. No. 916,666, filed June 19, 1978, commonly assigned. This latter discovery relates to an oxidation process, operated under elevated temperature and pressure.

In the oxidative contacting of an aqueous slurry of coal-oil particles with a gaseous oxygen-containing phase, such as air, an upflow reactor system is generally to be preferred. However, the coal-oil particles, usually associated with trapped air bubbles, tend to float on the aqueous phase. This property of floatability causes the coal-oil particles to move rapidly upward in the reactor system so that the residence time for the coal-oil particles in the reactor system is greatly reduced relative to that for the associated aqueous phase. Conventional baffling of the reactor system is generally without material effect on the disparity in residence times of the phases. Even though the shorter residence time of the coal-oil particles does lead to some oxidation, an effective means for increasing the residence time of the coal-oil particles would greatly improve the coal desulfurization without the necessity of resorting to a highly involved and less attractive reactor system.

SUMMARY OF THE INVENTION

This invention provides a practical method for more effectively reducing the sulfur content of coal particles, contained in an aqueous slurry of floatable coal-oil particles, by reaction therewith of an oxygen-containing gas at elevated temperature and pressure, comprising:

(a) feeding the oxygen-containing gas and the aqueous slurry of floatable coal-oil particles, at process pressure, to a bottom zone of a vertically disposed, elongated reactor vessel;

(b) passing the gas and aqueous slurry in cocurrent flow upwardly through a baffled reaction zone, maintained at reaction temperature and pressure, the baffled reaction zone having a plurality of baffle plates spaced therethrough generally normal to the reactor wall, each baffle plate having a configuration generally conforming to the internal diameter of the reactor vessel and a plurality of apertures disposed about the baffle plate, to provide a total aperture area equal to from about 3% to about 28% of the vessel cross-sectional area as free area;

(c) continuously withdrawing the aqueous slurry and spent gas from a top zone of the reactor vessel; and (d) recovering from the aqueous slurry coal-oil particles wherein the coal particles possess a reduced sulfur content.

The recovered coal-oil particles are suitable for use directly as a fuel having a reduced sulfur content. Alternatively, the oil can be removed from the recovered coal-oil particles to provide coal particles having a reduced sulfur content.

DESCRIPTION OF THE DRAWINGS

The figures presented herewith are illustrative, without limitation, of various embodiments of this invention.

FIG. 1 presents a longitudinal cross-sectional view of a vertically disposed, baffled reactor.

FIGS. 2 and 3 present, respectively, top and cross-sectional views of one preferred, apertured baffle arrangement.

FIGS. 4 and 5 present, respectively, top and cross-sectional views, illustrative of a preferred baffle arrangement having angular apertures.

DETAILED DESCRIPTION OF THE DRAWINGS

Figure 6:
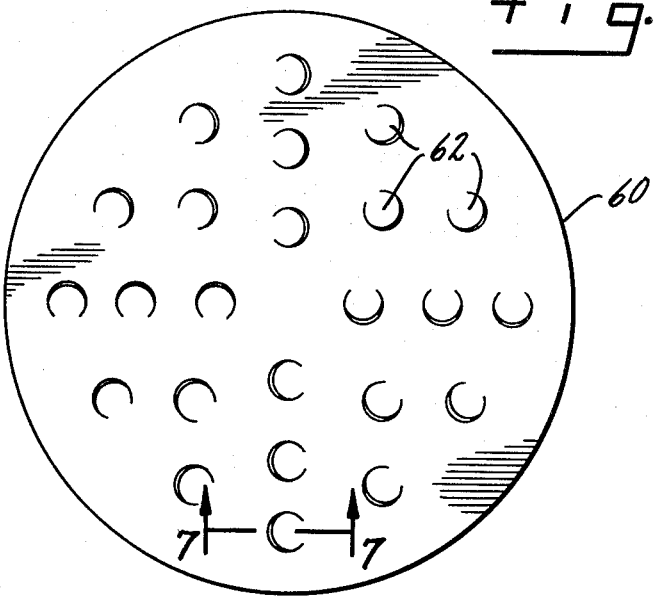
FIGS. 6 and 7 present, respectively, top and cross-sectional views, of a preferred baffle arrangement.

With reference to FIG. 1, there is shown a conventional upflow, tubular reactor 10 having standard inlet 11 and outlet 12 lines, together with appropriate valves and related equipment, not shown. A series of baffle plates 13 are spaced along the line of flow through the reactor.

With reference to FIGS. 2 and 3, baffle plate 20, substantially conforming in configuration to the internal diameter of a selected reactor, contains a series of apertures 21, extending through the baffle plate. The view of FIG. 3 shows the substantially cylindrical nature of the apertures.

With reference to FIGS. 4 and 5, baffle plate 40 contains a series of apertures 41 out through the baffle plate at an angle from the horizontal. The apertures may additionally be directed outwardly as shown.

Figure 7:
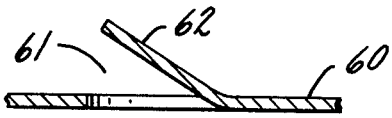

With reference to FIGS. 6 and 7, baffle plate 60 contains a series of apertures 61, created by cutting incomplete circular incisions in the baffle plate and punching the apertures through the plate in conformance with the incisions. The resulting apertures thus include a corresponding series of deflectors 62.

Figure 8:
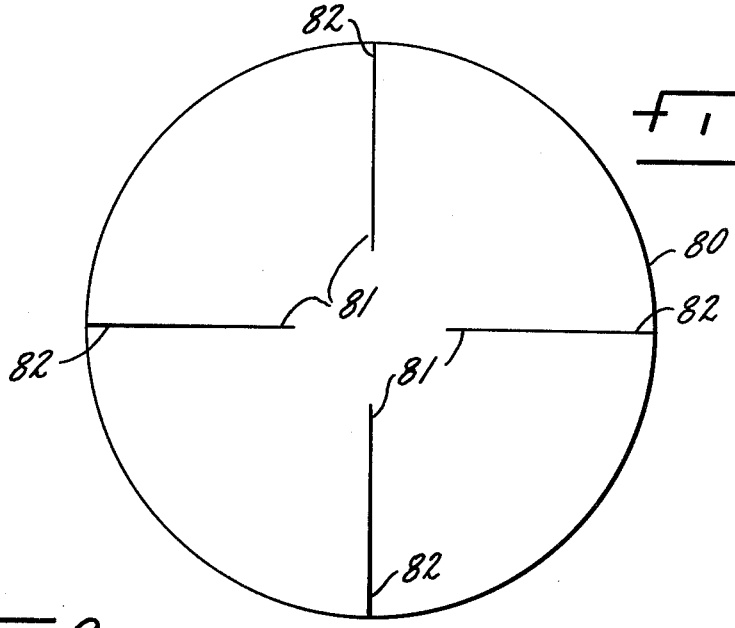
FIGS. 8 and 9 present, respectively, top and cross-sectional views of a preferred, pitched blade disk baffle arrangement.
Figure 9:
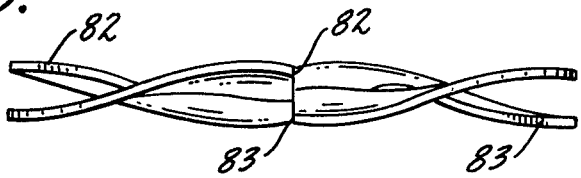

With reference to FIGS. 8 and 9, baffle plate 80 contains a series of radially oriented incisions 81. These incisions create two sets of edges 82 and 83 which may be pitched away from the horizontal baffle plane as desired.

DETAILED DESCRIPTION OF THE INVENTION

This invention provides a process for reducing the sulfur content of coal, by the treatment of coal particles, contained in an aqueous slurry of floatable coal-oil particles, with an oxygen-containing gas at elevated temperature and pressure, comprising:

(a) feeding the oxygen-containing gas and the aqueous slurry of floatable coal-oil particles, at process pressure, to a bottom zone of a vertically disposed, elongated reactor vessel;

(b) passing the gas and aqueous slurry in cocurrent flow upwardly through a baffled reaction zone, maintained at reaction temperature and pressure, the baffled reaction zone having a plurality of baffle plates spaced therethrough generally normal to the reactor wall, each baffle plate having a configuration generally conforming to the internal diameter of the reactor vessel and a plurality of apertures disposed about the baffle plate, to provide a total aperture area equal to from about 3% to about 28% of the vessel cross-sectional area as free area;

(c) continuously withdrawing the aqueous slurry and spent gas from a top zone of the reactor vessel; and (d) recovering from the aqueous slurry coal-oil particles wherein the coal particles possess a reduced sulfur content.

The novel process of this invention is especially effective for reducing the pyritic sulfur content of coal. An advantage of the process is that it can also provide a reduction in the organic sulfur content of some coals. Another advantage of the invention is that elemental sulfur formation and deposition is reduced. An additional advantage of the invention is that it can provide a reduction in the ash content of coal.

Suitable coals which can be employed in the process of this invention include brown coal, lignite, sub-bituminous, bituminous (high volatile, medium volatile, and low volatile), semiOanthracite, and anthracite. The rank of the feed coal can vary over an extremely wide range and still permit pyritic sulfur removal by the process of this invention. However, bituminous coals and higher ranked coals are preferred. Metallurgical coals, and coals which can be processed to metallurgical coals, containing sulfur in too high a content, can be particularly benefited by the process of this invention.

The coal particles employed in this invention can be provided by a variety of known processes, for example, by grinding or crushing, usually in the presence of water.

The particle size of the coal can vary over wide ranges. For instance, the coal may range from an average particle size of one-eighth inch in diameter to as small as minus 400 mesh (Tyler Screen) or smaller. Depending on the occurrence and mode of physical distribution of pyritic sulfur in the coal, the rate of sulfur removal will vary. If the pyrite particles are small and associated with the coal through surface contact or encapsulation, then the degree of grinding may have to be increased in order to provide for exposure of the pyrite particles. A very suitable particle size is often minus 24 mesh, or even minus 48 mesh as such sizes are readily separated on screens and sieve bends. For coals having fine pyrite distributed through the coal matrix, particle size distribution wherein from about 50 to about 85%, preferably from about 60 to 75% pass through minus 200 mesh is a preferred feed with top sizes as set forth above.

The hydrocarbon oil employed may be derived from sources such as petroleum, shale oil, tar sand or coal. Petroleum oils are generally to be preferred primarily because of their ready availability and effectiveness. Coal liquids and aromatic oils are particularly effective. Suitable petroleum oils will have a moderate viscosity, so that slurrying will not be rendered difficult, and a relatively high flash point, for ease of processing (i.e., separation) under higher than ambient conditions. Such petroleum oils may be either wide-boiling range or narrow-boiling range fractions; may be paraffinic, naphthenic or aromatic; and preferably are selected from among light cycle oils, heavy cycle oils, clarified oils, gas oils, vacuum gas oils, kerosenes and heavy naphthas, and mixtures thereof. In some instances, decanted or asphaltic oils may be used.

As used herein, "coal-oil particles" means either a small coal-oil aggregate or floc formed of several coal particles such that the aggregate is at least about two times, preferably from about three to twenty times, the average size of the coal particles which make up the aggregate, or a spherical agglomerate which includes a large plurality of particles such that the agglomerate size is quite large and generally spherical. These latter agglomerates generally form in the presence of larger proportions of oil. In general, the smaller coal-oil aggregates comprise a preferred feed component in this process.

The oil phase is desirably added as an emulsion in water. The preferred method is to effect emulsification mechanically by the shearing action of a high-speed stirring mechanism. Such emulsions should be contacted rapidly and as an emulsion with the coal-water slurry. Where such contacting is not feasible, the use of emulsifiers to maintain oil-in-water emulsion stability may be employed, particularly non-ionic emulsifiers. In some instances, the emulsification is effected in sufficient degree by the agitation of water, hydrocarbon oil and coal particles.

In the process of this invention, it is preferred to add the hydrocarbon oil, emulsified or otherwise, to the aqueous medium of coal particles and agitate the resulting mixture to aggregate the coal particles. The initial formation of coal-oil aggregates is effected with the addition of only a small proportion of oil. The aggregate of a few coal particles with a minor amount of oil generally is associated with air bubbles as a consequence of the agitation. Continued addition of oil to a substantial proportion promotes the formation of the larger coal-oil particles, or coal-oil agglomerates, which tend to be spherical in shape. The hydrocarbon oils employed in this invention are hydrophobic and will preferentially wet the hydrophobic coal particles. If necessary, the water content of the mixture can be adjusted to provide for optimum aggregation. Generally from about 50 to 99 parts, preferably from about 60 to 95 parts, and more preferably from about 70 to 95 parts water, based on 100 parts of coal-water feed, is suitable for coal-oil formation. There should be at least sufficient hydrocarbon oil present to aggregate the coal particles, but this amount should preferably be held to the minimum amount required for a suitable degree of aggregation. The optimum amount of hydrocarbon oil will depend upon the particular hydrocarbon oil employed, as well as the size and rank of the coal particles. Generally, the amount of hydrocarbon oil will be from about 1 to 15 wt. %, desirably from about 2 to 10 wt. %, based on coal. Most preferably the amount of hydrocarbon oil will be from about 3 to 8 wt. %, based on coal.

Agitating the mixture of water, hydrocarbon oil and coal particles to form coal-oil particles can be suitably accomplished using stirred tanks, ball mills or other apparatus. Temperature, pressure and time of contacting may be varied over a wide range of conditions. In the course of optimizing the use of oil in the aggregation step, the oil phase, whether in emulsified form or not, is preferably added in small increments until the desired total quantity of oil is present. The resulting coal-oil aggregates possess limited cohesive strength, but, if broken, as by shearing, readily form again and consequently afford a new solid phase.

Any process employed for aggregation of coal particles with oil effectively increases the particle size of the aggregate at least several fold over that of the untreated coal particle. Similarly the inclusion of oil in the aggregate as well as possible inclusion or attachment of air or other gas serves to decrease the apparent density, or specific gravity, of the coal particles.

After the coal-oil particles, whether aggregates or agglomerates, are formed, it is preferred to separate the coal-oil particles using, for example, suitable screens or filters. This separation step also allows for removal of some of the mineral matter, for example, ash. Preferably the separated coal-oil particles are washed with water. The separated coal-oil particles are re-slurried with water to the original coal concentration and then can be employed in the process involving contacting the coal-oil particles at elevated temperature with oxygen. While this is a preferred procedure, it is also within the scope of the invention to use the aqueous mixture of coal-oil particles which remains after the coal-oil particle forming procedure in the process of the invention involving contacting the coal-oil particles at elevated temperature with oxygen.

The process of this invention involves the contacting of an aqueous slurry of coal-oil aggregates at elevated temperature and pressure with an oxygen-containing gas. Pure oxygen may be employed in this process but it is preferred to use air or a mixture of oxygen with a suitable inert gas. One such mixture comprises air enriched with oxygen. Suitable elevated temperatures for the conduct of the process of this invention broadly fall within the range from about 150° to about 500° F., preferably from about 175° F. to about 375° F., and most preferably from about 225° F. to about 325° F. Suitable partial pressures of oxygen for the conduct of the process of this invention broadly fall within the range from about 10 psig to about 500 psig and preferably within the range from about 50 psig to about 300 psig.

Although batch treating is effective for the oxidative desulfurization of coal-oil particles, concurrent flow contacting is greatly desired to make the desulfurization process attractive for use in large-scale, economical desulfurization of large quantities of coal.

Conventional upflow, continuous reactors, moderately baffled to improve contact between gaseous and liquid phases, can be used for the conduct of the process of this invention. However, the coal-oil particles, which are initially well dispersed in the aqueous slurry, tend to float to the surface of the aqueous slurry phase and, when introduced into the vertical reactor, readily attach to gaseous bubbles and rise rapidly through the reactor. Accordingly, the reactor residence time for the coal-oil particles is less than the residence time for the coal-oil particles is less than the residence time for the attendant liquid phase. It has now been found that the residence time for the coal-oil particle phase can approach substantially the velocity of the liquid phase by the use of unique baffling arrangements employed in the process of this invention. This approach obviates the need for much larger reactor sizes in order to provide an adequate residence time required for effective desulfurization of the coal-oil particles.

One suitable baffling arrangement, as illustrated by FIGS. 2 and 3, comprises a plurality of perforated baffle plates, positioned generally horizontally in the vertical, tubular reactor and having a configuration generally corresponding to the internal diameter of the reactor. The baffle plates are preferably positioned to avoid bypassing at the reactor wall and may incorporate any conventional sealing arrangement to accomplish this. When the baffle plates are properly positioned, the perforations comprise apertures, which can have a wide variety of configurations positioned across the baffle plane. Each aperture has a relatively small diameter so that the total aperture area of a plurality of the apertures is from about 3% to about 28%, preferably from about 5% to about 25%, of the internal cross-sectional area of the reactor. The number of apertures is selected such that the open, or free, area afforded by each aperture comprises only from about 0.1% to about 10%, preferably from about 0.5% to about 5%, of the reactor cross-sectional area.

With this baffling arrangement, it has been observed that the coal-oil particles tend to hold up on the bottom face of each baffle plate so that there is a significant increase in the time required for passage through the baffle apertures. It has been found that with an open area greater than about 28% of the total cross-sectional area the hold-up effect of the coal-oil particles is slight and the particles tend to float upwardly rapidly with the gaseous phase. The open area must, however, be sufficient to permit passage of the reactants with the development of little or no pressure gradient across each baffle of the reactor.

Other suitable baffling arrangements can desirably extend the residence time of the coal-oil particles by effectively lengthening their flow paths through the reactor. One such baffling arrangement can be provided by cutting apertures through the baffle plate at an angle, for example, of from about 10° to about 60°, and preferably from about 25° to about 45°, from the substantially horizontal plane of the baffle plate. Such a baffling arrangement is illustrated by FIGS. 4 and 5. With this baffling arrangement, the flow pattern of the coal-oil particles is modified by an angular thrust. When the apertures are additionally directed outwardly, the coal-oil particles are induced into a spiral flow pattern or a swirling path as they rise through the vertical distance between respective baffle plates. A particularly preferred angle for the outwardly directed apertures is about 30° from the plane of the baffle plate.

Another baffling arrangement effective for increasing the residence time of coal-oil aggregates in the reaction zone comprise deflecting means located about the apertures. The deflector serves to interrupt an otherwise smooth upward flow. Preferably, the deflectors are positioned to induce a suitably lengthened flow path, for example, a spiral flow path for the moving coal-oil particles. A baffling arrangement with deflecting apertures can be provided by making partial cuts through the plate and subsequently punching therethrough, pushing up a lip forming an aperture and deflector plate. Such a baffling arrangement is illustrated, for example, by FIGS. 6 and 7.

These alternate baffling arrangements also require that the free portion of the cross-sectional area be limited so as to achieve adequate hold-up of the particles beneath the respective baffle plates.

Another suitable baffling arrangement comprises a plurality of circular baffle plates positioned substantially horizontally, or generally normal to the interior wall of the vertical, tubular reactor, with apertures created by effecting a series of incisions along the baffle circumference. The incisions are spaced generally symmetrically along the baffle circumference and extended inwardly along a portion of respective radii. The cut portion of each radius thus provides two edges which can be pitched at an angle from the normal plane of the baffle plate to define the aperture and the aperture area. The total aperture area, measured in the vertical plane, thus defined is equal to from about 3% to about 28% of the internal cross-sectional area of the reactor vessel.

When viewed as a unit, the incisions thus provide a pitched blade disk. The number of symmetrically positioned incisions may vary as desired but will generally be within the range from about 2 to about 8. A preferred and convenient arrangement employs four apertures. Each incision may be cut along a selected radius for any reasonable extent thereof, preferably extending from about 50% to about 75% of the radial distance, limited only by considerations of structural soundness and stability. The pitched aperture edge members define an aperture effectively oriented substantially parallel to the horizontal plane of the baffle plate and thus greatly extending the flow path of the coal-oil particles as they pass upwardly through the reactor. A suitable angle of pitch is within the range from about 5° to about 30°, preferably from about 5° to about 15°, from the normal plane of the baffle plate and is selected, together the length of each incision, to define for each individual aperture a free area corresponding to from about 0.1% to about 10%, preferably from about 0.5% to about 5%, of the vessel cross-sectional area.

In a preferred pitched blade disk embodiment, the members of one set of corresponding edges of the respective incisions are pitched upwardly from the normal plane of the baffle plate, that is, in the direction of flow. This will provide a preferred lengthened upward spiral flow pattern.

As with the previously described baffle plates of this invention, there is a pronounced tendency for the coal-oil aggregates to hold up below the respective baffle plates, increasing the residence time of the aggregates in the reactor. The total free area defined by the apertures must accordingly be limited sufficiently to permit such hold-up to occur.

In the various embodiments of this invention, the baffle plate arrangements may comprise various types of apertured plates, mixed in any desired manner, and spacings may be varied along the vertical length of the reactor. The sizing of the apertures will be such that the dimensions of the coal-oil particles permit their passage readily through the apertures despite the tendency to hold up beneath the baffle plates. The baffle plates may be constructed of any conventional material for use at the indicated temperatures and pressures, although a preferred material of construction is a stainless steel alloy.

The baffle plates with the angular apertures or deflector plates, as well as the pitched blade disk, may be arranged to provide a reversed flow by the selective positioning and orientation of the baffle plates. For example, a first baffle plate can direct the flow pattern in a clockwise spiral flow pattern, and the next successive baffle plate can direct the flow pattern in a counter clockwise spiral flow pattern. The process of reversing the lateral flow pattern in this manner can be repeated.

It should be observed that the coal-oil particles, preferably aggregates, possess limited cohesive strength and can be temporarily broken apart and then reformed from time to time during their upward passage through the reactor. Similarly, the hold-up of coal-oil aggregates that may tend to form beneath the modified baffle plates do not possess the cohesive strength normally associated with the generally larger coal-oil agglomerates and can readily break apart in the absence of restrictive forces or as a consequence of the forces associated with the longer elliptical or irregular flow patterns that may be induced or imposed.

Suitable baffle plate spacing along the length of the tubular reactor vessel may vary in distance from about 0.1 to 6 times the internal diameter of the reactor vessel. A preferred spacing is from about 0.2 to about 2 diameters depending upon the internal diameter of the reactor vessel. A particularly preferred baffle spacing is from about 6 inches to about 36 inches. For example, in a reactor vessel having a 8 foot internal diameter, a preferred baffle spacing is within the range from about 12 to about 36 inches, and more preferably from about 16 to about 30 inches.

Tables I and II illustrate the effectiveness of various baffle modifications upon the flow rate of the coal-oil aggregate phase (containing 7.5 wt. % heavy vacuum gas oil) when directed upwardly through a vertical tubular vessel. All tests were conducted in a tubular vessel (4" I.D.×18' 6") employing a variety of baffle arrangements. With each arrangement air and water flows were brought to a steady state and a slug of coal-oil aggregate was introduced at the bottom of the vessel. Samples were taken at intervals from the top of the vessel to determine the average coal residence time. Under the conditions employed in Table I, the average liquid phase residence time was 27.7 minutes. Similarly, the Table II conditions gave a liquid phase residence time of 6.3 minutes.

The coal residence time most nearly approaches that of the aqueous phase when employing low free areas and relatively short baffle spacings. Lengthened residence times are maximized when employing pitched blade disks, or baffle plates deflector plates, or angled apertures, which provide a spiral flow pattern, although the smaller straight apertures were likewise effective. The magnitude of the increase in coal residence time, when compared with the ineffectiveness of the baffles having larger free areas, is surprisingly large and greatly enhances the opportunity for continuous coal desulfurization in an economic and attractive manner.

TABLE 1

| COAL RESIDENCE TIMES* | | | |
|---|---|---|---|
| Baffle Design | | | Residence |
| Aperture | Free Area, % | Spacing, in. | Time, min. |
| — | 100 | — | 5.35 |
| ¼", straight | 40 | 12 | 5.25 |
| " | 10 | 12 | 10.1 |
| " | 10 | 5 | 14.1 |
| 3/16", straight | 25 | 12 | 7.0 |
| " | 6 | 5 | 18.0 |
| ⅛", straight | 10 | 12 | 15.6 |
| 3/16", 30° angle | 11.5 | 5 | 12.5 |
| " | 6 | 5 | 18.8 |
| ¼", punched w/lip | 5 | 5 | 19.5 |
| " | 10 | 5 | 20.1 |
| Spiral Disk | 5 | 6 | 19.7 |
| " | 5 | 4 | 20.2 |

*All tests conducted at 60° F., liquid flow rate 20 gal./hr., gas flow rate 0.4 SCF/M.

TABLE II

| COAL RESIDENCE TIMES** | | | |
|---|---|---|---|
| Baffle Design | | | Residence |
| Aperture | Free Area, % | Spacing, in. | Time, min. |
| ¼", straight | 40 | 12 | 1.55 |
| " | 10 | 5 | 3.15 |
| ¼", punched lip | 10 | 5 | 3.70 |
| Spiral Disk | 5 | 6 | 2.77 |
| " | 5 | 4 | 3.59 |
| Reverse spiral disk | 5 | 4 | 3.88 |

**All tests conducted at 60° F., liquid flow rate 90 gal./hr., gas flow rate 0.4 SCF/M.

In the practice of the process of this invention the superficial velocity of the oxygen-containing gas stream rising through the baffled reaction zone, at reaction temperature and pressure, may suitably be within the range from about 0.01 to about 0.4 ft./sec., and preferably within the range from about 0.08 to about 0.2 ft./sec. Similarly, the velocity of the aqueous slurry phase may suitably be within the range from about 0.25 to about 4.0 ft./min.

In the process of this invention oxygen gas and water are involved in the removal of pyritic sulfur from coal. This removal involves oxidation of the pyritic sulfur to sulfate, poly-thionate and th osulfate forms. When coal containing pyritic sulfur is subjected to the defined process conditions, the aqueous slurry becomes progressively more acidic as sulfuric acid is formed in the reaction. Although sulfur removal can be effected without regulating the acidity of the reaction system, it has been found that enhanced sulfur removal can be achieved by maintaining the pH of the aqueous slurry phase within the range from about 6.0 to about 12.0. The desired pH range is suitably maintained in the aqueous slurry phase by the addition thereto of an alkaline material.

Examples of suitable alkaline, or basic, materials, which can be employed to regulate the pH of the aqueous slurry are alkali metal hydroxides, such as sodium hydroxide, potassium hydroxide, and their corresponding oxides. Other suitable basic materials include alkali metal carbonates, such as sodium carbonate, sodium bicarbonate, potassium bicarbonate, ammonia, ammonium bicarbonate and ammonium carbonate. Particularly suitable are alkaline earth metal hydroxides, their corresponding oxides, and carbonates, for example, calcium hydroxide, lime and limestone. Among these basic materials, sodium bicarbonate, potassium bicarbonate, ammonium carbonate and bicarbonate are preferred. Limestone is most preferred since it can provide the desired pH and at the same time react with sulfur species removed from the coal to form more environmentally acceptable compounds, e.g., gypsum. Suitable basic materials also include suitable buffering agents, generally the salts of weak acids, for example, boric acid, and strong bases.

The presence of hydrocarbon oil enhances removal of sulfur from coal in the process although this enhancement is not fully understood. While not wishing to be bound by any particular theory, it is speculated that in the presence of oxygen the hydrocarbon oils may form organic hydroperoxides and/or peroxides which in turn, may preferentially promote the oxidation of sulfur in the coal, forming water-separable sulfur compounds.

Following the oxidative desulfurization reaction, the aqueous slurry, containing the treated coal-oil particles, and the spent oxygen-containing gas stream are withdrawn from a top zone of the reactor vessel. Should further desulfurization be desirable the aqueous slurry containing the treated coal-oil particles may be recycled to the reaction zone, in whole or in part, or the treated coal-oil particles may be separated and re-slurried prior to recycle. The spent gas stream may be separated from the aqueous slurry in any conventional manner, as, for example, in a hydroclone. If desired, the spent gas stream may be fortified with oxygen gas and recycled to the reaction zone.

The aqueous slurry can then be subjected to a suitable separation process to effect segregation of the treated coal-oil particles. Such a liquid-solids separation can be effected in a number of ways. Filtering with bar sieves or screens, or centrifuging, for example, can be employed.

The resulting coal-oil particles are coal-oil particles wherein the coal portion is reduced in sulfur content. These coal-oil particles are an excellent low sulfur, reduced ash fuel and can be used as such.

If desired, the oil can be removed from these coal-oil particles to provide coal particles reduced in sulfur content. A variety of methods can be employed to remove the hydrocarbon oil from the coal-oil particles. For example, the particles can be washed with an organic solvent, such as hexane or toluene, in which the hydrocarbon oil is soluble, and thereafter separating the resulting solution from the coal particles.

The resulting coal product has a substantially reduced pyritic sulfur content and can also exhibit a diminished organic sulfur content. For example, in some coals up to 30%, by weight, organic sulfur is removed. In addition the coal product can be reduced in ash. Preferably, the coal is dried prior to use or storage.

In an exemplary embodiment of this invention, Scurfield coal was ground and screened. The coal particles having a particle size less than 80 mesh were collected and stirred with sufficient water to provide an 18% slurry of coal in water. Heavy vacuum gas oil was then added gradually to the slurry, with continued stirring, in the amount of 7.5 wt. %, based on the coal particles. The resulting slurry of coal-oil particles, after adjusting the pH value to 11.3, was treated with air in a co-current upflow reactor system, comprising a baffled tubular steel reactor (4" I.D.×18.5' length), at 300 psig. and 280° F. Slurry feed rate was maintained at 12 gal./hr. and the air rate at 4 SCF/M to provide a superficial gas velocity of 0.08 ft./sec. The product slurry, whose pH value was reduced to 7.8, was separated into its component parts and the recovered coal-oil particles were washed with light hydrocarbon to remove the gas oil.

Coal residence time averaged only 5.4 minutes as compared to 42.7 minutes for the aqueous phase. However, the sulfur content of the coal particles was reduced from 1.5 wt. % to only 1.17 wt. %.

What is claimed is:

1. A process for reducing the sulfur content of coal, by the treatment of coal particles, contained in an aqueous slurry of floatable coal-oil particles, with an oxygen-containing gas at elevated temperature and pressure, comprising the steps of:

(a) feeding the oxygen-containing gas and the aqueous slurry of floatable coal-oil particles, at process pressure, to a bottom zone of a vertically disposed, elongated reactor vessel;

(b) passing the gas and aqueous slurry in cocurrent flow upwardly through a baffled reaction zone, maintained at reaction temperature and pressure, the baffled reaction zone having a plurality of baffle plates spaced therethrough generally normal to the reactor wall, each baffle plate having a configuration generally conforming to the internal diameter of the reactor vessel and a plurality of apertures disposed about the baffle plate, to provide a total aperture area equal to from about 3% to about 28% of the vessel cross-sectional area as free area;

(c) continuously withdrawing the aqueous slurry and spent gas from a top zone of the reactor vessel; and (d) recovering from the aqueous slurry coal-oil particles wherein the coal particles possess a reduced sulfur content.

2. The process of claim 1 wherein the baffled reaction zone has a plurality of circular, apertured baffle plates spaced therethrough normal to the reactor wall, each baffle plate having a configuration generally conforming to the internal diameter of the reactor vessel and a plurality of substantially cylindrical apertures, the apertures being symmetrically disposed through the plane of the baffle plate to provide from about 5% to about 25% of the vessel cross-sectional area as free area with each aperture affording from about 0.1% to about 10% of the vessel cross-sectional area as free area.

3. The process of claim 2 wherein each aperture affords from about 0.5% to about 5% of the vessel cross-sectional area as free area.

4. The process of claim 2 wherein the baffle plate apertures are set angularly through the baffle plate, describing an angle of from about 10° to about 60° from substantially horizontal plane of the baffle plate, and directed outwardly to impose a spiral flow pattern.

5. The process of claim 4 wherein the baffle plate apertures describe an angle of about 30° from the plane of the baffle plates.

6. The process of claim 2 wherein the baffle plate apertures are punched through the baffle plate to provide a lip protruding from the upper plane surface of the baffle plate.

7. The process of claim 1 wherein each baffle plate is a pitched blade disk having a configuration generally conforming to the internal diameter of the reactor vessel and a plurality of apertures, each aperture being described by an incision directed inwardly along a portion of a baffle radius to provide members of two sets of corresponding edges, the members of at least one set of corresponding edges of the respective incisions being pitched from about 5° to about 30° from the normal plane of the baffle plate to describe a total aperture area equal to from about 3% to about 28% of the vessel cross-sectional area as free area, each aperture affording an area equal to from about 0.1% to about 10% of the vessel cross-sectional area.

8. The process of claim 7 wherein each aperture affords from about 0.5% to about 5% of the vessel cross-sectional area as free area.

9. The process of claim 7 wherein the baffle plate has four apertures.

10. The process of claim 7 wherein the first set of corresponding edges of the respective incisions is pitched upwardly from the normal plane of the baffle plate.

11. The process of claim 7 wherein alternate members of each of the first set and the second set of corresponding edges of the respective incisions are pitched upwardly from the normal plane of the baffle plate.

12. The process of claim 1 wherein the reaction zone baffle spacing distance is from about 0.1 to about 6 times the internal diameter of the reactor.

13. The process of claim 12 wherein the reaction zone baffle spacing distance is from about 0.2 to about 2 times the internal diameter of the reactor.

14. The process of claim 1 wherein the coal is selected from the group consisting of bituminous and higher ranked coal.

15. The process of claim 1 wherein the oil contained in the coal-oil particles is derived from petroleum, shale oil, tar sand or coal.

16. The process of claim 15 wherein the oil contained in the coal-oil particles is a refined petroleum fraction selected from the group consisting of light cycle oil, heavy cycle oil, gas oil, vacuum gas oil, and kerosene.

17. The process of claim 1 wherein the coal-oil particles contain from about 1% to about 15% by weight of oil.

18. The process of claim 17 wherein the coal-oil particles contain from about 2% to about 10% weight of oil.

19. The process of claim 18 wherein the coal-oil particles contain from about 3% to about 8% by weight of oil.

20. The process of claim 1 wherein the aqueous slurry contains from about 1% to about 50% by weight of coal particles.

21. The process of claim 20 wherein the aqueous slurry contains from about 5% to about 40% by weight of coal particles.

22. The process of claim 21 wherein the aqueous slurry contains from about 5% to about 30% by weight of coal particles.

23. The process of claim 1 wherein the oxygen-containing gas is air.

24. The process of claim 1 wherein the oxygen-containing gas comprises oxygen gas together with an inert gas.

25. The process of claim 1 wherein the reaction temperature is within the range from about 150° to about 500° F.

26. The process of claim 25 wherein the reaction temperature is maintained within the range from about 225° F. to about 325° F.

27. The process of claim 1 wherein the oxygen partial pressure is maintained within the range from about 10 to about 500 psi.

28. The process of claim 27 wherein the oxygen partial pressure is maintained within the range from about 50 to about 300 psi.

29. The process of claim 1 wherein the superficial velocity of the oxygen-containing gas rising through the baffled reaction zone is within the range from about 0.01 to about 0.4 ft./sec.

30. Process of claim 29 wherein the superficial velocity of the oxygen-containing gas rising through the baffled reaction zone is within the range from about 0.08 to about 0.2 ft./sec.

31. The process of claim 1 wherein the velocity of the aqueous slurry rising through the baffled reaction zone is from about 0.5 to about 4.0 ft./min.

32. The process of claim 1 wherein a pH within the range from about 6.0 to about 12.0 is maintained in the aqueous slurry by the addition of an alkaline-reacting material thereto.

33. The process of claim 32 wherein the alkaline-reacting material is an alkaline earth material.

34. The process of claim 33 wherein the alkaline earth material is selected from the group consisting of calcium hydroxide, limestone, and mixtures thereof.

35. The process of claim 1 wherein the oil is removed from the recovered coal-oil particles to provide recovered coal particles having a reduced sulfur content.

* * * * *